United States Patent [19]

Shim

[11] 4,378,297

[45] Mar. 29, 1983

[54] LUBRICATING SEALANTS

[75] Inventor: Kyung S. Shim, Irvington, N.Y.

[73] Assignee: Stauffer Chemical Company, Westport, Conn.

[21] Appl. No.: 300,776

[22] Filed: Sep. 10, 1981

[51] Int. Cl.[3] ..... C10M 5/02; C10M 5/12

[52] U.S. Cl. ..... 252/28; 252/52 R

[58] Field of Search ..... 252/28, 52 R

[56] References Cited

U.S. PATENT DOCUMENTS 2,563,606 8/1951 Kimberlin et al. ..... 252/28

2,820,764 1/1958 Hughes et al. ..... 252/28

3,004,921 10/1961 Stossel ..... 252/28

FOREIGN PATENT DOCUMENTS 2210886 3/1971 Fed. Rep. of Germany .

*Primary Examiner*—Jacqueline V. Howard

*Attorney, Agent, or Firm*—Howard K. Kothe

[57] ABSTRACT

Lubricating sealants which are resistant to aprotic solvents such as chloroform and carbon disulfide are prepared by forming a grease comprising glycerine, fumed silica, polyethylene glycol and a minor amount of water.

2 Claims, No Drawings

LUBRICATING SEALANTS

BACKGROUND OF THE INVENTION

The present invention relates to novel chemical-resistant sealing and lubricating compositions. More particularly, the present invention relates to a grease composition which is chemically-resistant and is useful for lubricating and/or sealing mechanical seals, valves, flanges and the like.

Although there are many grease compositions known in the art, surprisingly few of them are chemically resistant.

One grease composition which is said to be chemically-resistant is taught by U.S. Pat. No. 2,563,606. In accordance with this patent a grease is prepared by replacing the water in a hydrogel such as silica, alumina, stannia, etc., with a liquid which has lubricating properties but which is suitably resistant to solution or reaction with the chemicals which it is expected to contact. Example 1 of this patent shows the preparation of a silica by the reaction of sodium silicate with sulfuric acid; and use of the silica product to form a grease comprising 6.4% silica and 93.6% glycerine. An essential step in the process is the milling of the silica in the presence of the lubricating liquid.

Although the liquid component of the grease taught by the patent may be resistant to specific chemicals, the overall quality of the resulting grease may be less than desirable.

In addition to pure chemical resistance, considerations must be given to hygroscopicity, thixothropy and weather-resistance. Thus, for example, the grease should be thixotropic so that it will flow well then being pumped through a grease fitting, but then have sufficient body so as not to flow out of the mechanism to which it has been applied. The grease should also be sufficiently water-resistant so that it will not be washed out of, for example, a valve or a pair of flanges when installed outside and exposed to rainfall.

U.S. Pat. No. 3,107,219 teaches an "energizable" grease composition comprising a base lubricant which is a polyhydric alchohol or derivative thereof, a thickener which is at least ⅔ potash soap, and a gas entraining agent.

It would be expected that this grease would be unsuitable for some chemical operations because the presence of the potassium ion as well as the gas entraining agents could lead to harmful effects.

It is therefore apparent that a need exists for a new grease composition that is chemically-resistant, has good grease properties, and contains no harmful ionic-salts or surfactant components.

SUMMARY OF THE INVENTION

It has now been found that a chemically resistant grease composition having good grease properties can be formulated without the need for ionic-salts or surfactant components. The novel grease composition of the present invention is comprised of glycerine, fumed silica, polyethylene glycol and a minor amount of water.

DETAILED DESCRIPTION OF THE INVENTION

In accordance with the present invention there is now provided a lubricating and sealing grease composition comprising glycerine, fumed silica, polyethylene glycol and a minor amount of water.

In preparing the grease composition of the present invention it is preferable to first mix the glycerine with the fumed silica and then add the polyethylene glycol and water, although the components can be mixed in any other order as well.

No special mixing equipment is required.

The amount of glycerine used ranges from about 50% to about 95% by weight of total composition, although an amount ranging from about 85–95% is preferred.

The fumed silicas used in the practice of the present invention have surface areas ranging from about 50 to about 380 meter$^2$/gram, and are available from Cabot Corperation as well as other manufactureres. A preferred fumed silica is that marketed by Cabot Corporation under the trademark Cab-O-Sil M 5. The amount of fumed silica used is preparing the grease composition of the present invention ranges from about 1% to about 25% by weight of total composition, although an amount ranging from about 5% to about 12% is preferred.

The polyethylene glycols used in preparing the composition of the present invention preferably have molecular weights of at least about 500, although a molecular weight of about 1000 is particularly preferred. An especially preferred polyethylene glycol is that marketed by Union Carbide Corperation under the trademark Carbowax 1000, and is said to have two-OH groups per 1000 molecular weight. The polyethylene glycol is included in the composition of the present invention in an amount ranging from about 0.5% to about 50% by weight of total composition, with the preferred amount ranging from about 2% to about 4%.

The water which is used in the practice of the present invention is believed to improve the physical stability of the grease composition by promoting hydrogen bonding. The water is added in only minor amounts for this purpose, ranging from about 0.01% to about 2% by weight of total composition, although preferred amounts range from about 0.1% to 0.5% by weight.

Although not an essential part of the present invention, it would be within the scope of the present invention to include in the grease composition such usual additives as antioxidants, corrosion inhibitors, extreme pressure agents, and the like, as long as they are compatible with the system in which the grease is to be used.

The grease composition of the present invention is an effective lubricating and sealing composition, is resistant to aprotic solvents, such as chloroform and carbon disulfide, has good body and, although it can be dissolved or dispersed in water, is water-resistant.

In order that the present invention be more fully understood, the following examples are given by way of illustration. No specific details or enumerations contained therein should be construed as limitations except insofar as they appear in the appended claims. All parts and percentages are by weight unless otherwise specifically designated.

EXAMPLE 1

A grease was prepared by mixing glycerine (88.1%) fumed silica (Cab-O-Sil M 5 from Cabot Corperation-8.3%), polyethylene glycol (Carbowax 1000 from Union Carbide Corperation-3.3%) and water (0.27%). This grease was insoluble in carbon disulfide, had a viscosity of 7,000 pascal-seconds at 25° C. and was effectively sealed moving parts, such as mechanical seals, against carbon disulfide at temperatures ranging from −20° to 60° C.

This demonstrates the effectiveness of the grease composition of the present invention.

EXAMPLE 2

A field test was conducted to determine the weather resistance of the grease compositions of the present invention. In this test a strip of the grease, prepared as in Example 1, was placed on the outside of an "outdoors" reactor having a surface temperature of about 50° C. A similar strip of a commercial sealant, known to be glycerine-based, was placed next to the first.

Following a period of rainfall it was found that the commercial sealant had been washed away while the composition of the present invention appeared to be undisturbed.

This demonstrates the weather-resistance of the composition of the present invention.

I claim:

1. A grease composition comprising glycerine, fumed silica, polyethylene glycol and water wherein the amount of glycerine ranges from about 50 to about 95 weight % of the total composition, the amount of fumed silica ranges from about 1 to about 25% by weight of the total composition, the amount of polyethylene glycol ranges from about 0.5% to about 50% by weight of total composition and the amount of water ranges from about 0.01% to about 1.0% by weight of total composition.

2. The grease composition of claim 1 wherein said polyethylene glycol is polyethylene glycol having a molecular weight of at least 500.

* * * * *